US012017124B2

(12) United States Patent
Grenier et al.

(10) Patent No.: US 12,017,124 B2
(45) Date of Patent: Jun. 25, 2024

(54) GOLF CLUB HEAD

(71) Applicant: SUMITOMO RUBBER INDUSTRIES, LTD., Kobe (JP)

(72) Inventors: Jake Grenier, Huntington Beach, CA (US); Phillip Seagram, Somerville, MA (US); Joseph Chen, Costa Mesa, CA (US); Dustin Brekke, Fountain Valley, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 17/476,759

(22) Filed: Sep. 16, 2021

(65) Prior Publication Data

US 2022/0001251 A1 Jan. 6, 2022

Related U.S. Application Data

(62) Division of application No. 16/734,851, filed on Jan. 6, 2020, now Pat. No. 11,148,018.

(60) Provisional application No. 62/846,085, filed on May 10, 2019.

(51) Int. Cl.
*A63B 53/04* (2015.01)

(52) U.S. Cl.
CPC ..... *A63B 53/047* (2013.01); *A63B 53/0408* (2020.08); *A63B 53/0433* (2020.08); *A63B 2053/0479* (2013.01)

(58) Field of Classification Search
CPC ..... A63B 53/047; A63B 53/0408; A63B 53/0433; A63B 53/02; A63B 2053/0479; A63B 2053/0483
USPC ..... 473/305, 324
See application file for complete search history.

(56) References Cited

U.S. PATENT DOCUMENTS

| | | | | |
|---|---|---|---|---|
| 1,266,529 | A * | 5/1918 | Mattern | A63B 60/00 473/315 |
| 5,395,109 | A * | 3/1995 | Fenton, Jr. | A63B 53/02 473/343 |
| 6,811,496 | B2 | 11/2004 | Wahl et al. | |
| 10,493,336 | B2 * | 12/2019 | Taylor | A63B 60/00 |
| 11,148,018 | B2 * | 10/2021 | Grenier | A63B 60/52 |
| 2003/0022729 | A1 | 1/2003 | Pergande et al. | |
| 2003/0176235 | A1 * | 9/2003 | Burrows | A63B 53/02 473/305 |
| 2004/0147335 | A1 * | 7/2004 | Iwata | A63B 53/047 473/291 |
| 2004/0157679 | A1 * | 8/2004 | Poincenot | A63B 53/047 473/324 |

(Continued)

*Primary Examiner* — John E Simms, Jr.

(74) *Attorney, Agent, or Firm* — Oliff PLC

(57) ABSTRACT

A golf club head includes a loft no less than 40 degrees; a striking face; a virtual center plane that is vertical and perpendicular to a virtual striking face plane and includes a face center; a rear face; and a recess. The recess extends in a heel-to-toe direction along an upper sole surface and has a depth that varies in the heel-to-toe direction such that a first depth corresponds with a first location heel-ward of the face center and a second depth corresponds with a second location toe-ward of the face center, the first depth being no less than 10 mm and greater than the second depth by at least 5 mm. An insert is received in the recess. And a center of gravity of the golf club head is spaced no greater than 5.0 mm from the virtual center plane measured in the heel-to-toe direction.

12 Claims, 10 Drawing Sheets

(56) References Cited

U.S. PATENT DOCUMENTS

| | | | | |
|---|---|---|---|---|
| 2005/0085312 | A1* | 4/2005 | Nagai | A63B 60/02 473/291 |
| 2005/0239572 | A1 | 10/2005 | Roach et al. | |
| 2006/0025237 | A1* | 2/2006 | Aguinaldo | A63B 53/047 473/350 |
| 2008/0015051 | A1 | 1/2008 | Roach et al. | |
| 2010/0130307 | A1 | 5/2010 | Roach et al. | |
| 2010/0279787 | A1* | 11/2010 | Stites | A63B 53/02 473/282 |
| 2010/0279794 | A1* | 11/2010 | Nicolette | A63B 53/047 473/349 |
| 2012/0157224 | A1 | 6/2012 | Finn et al. | |
| 2012/0196702 | A1* | 8/2012 | Shimazaki | A63B 53/047 473/345 |
| 2012/0289360 | A1* | 11/2012 | Breier | A63B 53/047 473/335 |
| 2015/0328506 | A1 | 11/2015 | Morales et al. | |
| 2016/0144248 | A1* | 5/2016 | Chen | A63B 53/0475 29/592 |
| 2017/0120112 | A1* | 5/2017 | Stokke | A63B 53/047 |
| 2017/0246517 | A1 | 8/2017 | Ueda et al. | |
| 2017/0274253 | A1* | 9/2017 | Stokke | A63B 53/047 |
| 2017/0304691 | A1 | 10/2017 | Morales et al. | |
| 2018/0093145 | A1* | 4/2018 | Ripp | A63B 60/50 |
| 2018/0189758 | A1* | 7/2018 | Beach | A63B 53/04 |
| 2018/0318664 | A1* | 11/2018 | Ripp | A63B 60/00 |

* cited by examiner

GOLF CLUB HEAD

CROSS-REFERENCE TO RELATED APPLICATION

This is a Divisional of application Ser. No. 16/734,851 filed Jan. 6, 2020, which in turn claims the benefit of U.S. Provisional Application No. 62/846,085, filed May 10, 2019. The disclosure of that prior application is incorporated by reference herein in its entirety.

BACKGROUND

Golfers are increasingly demanding greater performance from their equipment. As golf equipment is regulated with particular attention to limiting shot distance, a performance metric of increasing significance is shot dispersion. This metric has special significance for higher-lofted, wedge-type golf clubs, which are often used to hit shots at shorter distances to the pin thus requiring greater precision and control than, say, drives. For mid to high handicap golfers, shot dispersion tends to be significantly greater than for low handicap and professional golfers. Over the years, "game improvement" wedge-type golf club heads have been developed to help to lower this increased shot dispersion. Such golf club heads often include perimeter weighting and rear cavities that attempt to provide a larger sweet area and greater forgiveness on off-center impact.

One reason for the increased shot dispersion among higher handicap golfers is that, often, the swing tendencies of these golfers are such that they tend to make impact with the golf ball in a less than ideal impact location of the golf club head's face. Higher handicap golfers tend to make more inconsistent contact with the golf ball and thus may benefit from using club heads with a larger sweet area. However, conventional club heads, particularly higher-lofted club heads—in combination with increasing sweet area—may not have adequately accounted for impact tendencies of higher-handicapped golfers in a generalized sense. For example, simply increasing sweet area may not sufficiently account for a particular subset of golfers' tendency to impact golf balls at an average point of contact offset as compared to, say, a different subset or a generalized notion of the set of golfers as a whole.

SUMMARY

High handicap golfers tend to hit toward the toe side of the golf club head. This tendency is problematic. Due to the conventionally asymmetric shaping of iron and wedge-type golf club heads, the center of gravity (CG) of golf club heads is often heel-side biased. Generally, golfers want to make impact on the "sweet spot" of the golf club head's face, which is the CG location projected onto the face, to impart optimum velocity, trajectory, and spin to the golf ball. Hitting farther away on average from this sweet spot can greatly magnify the effects of overall inconsistent ball contact. Attempts to provide a mass-centered golf club head by, e.g., moving discretionary mass from the heel side of the golf club head to the toe side, can result in a golf club head that appears unbalanced, which may be distracting to the golfer or miscommunicate to the golfer the effectiveness of the club head. Other efforts to provide a more centered golf club head, e.g., by adding high density weighting on the toe side of the golf club head, can be expensive and require undue structuring that could compromise other desirable aspects of the club head.

Thus, there is a need for a game improvement wedge-type golf club head that is forgiving yet takes into account specific tendencies of high handicap golfers.

A golf club head according to a non-limiting example of the present disclosure may, when oriented in a reference position, thus include: a loft no less than 40 degrees; a striking face having a face center and a virtual striking face plane generally parallel to the striking face; a virtual center plane that is vertical and perpendicular to the virtual striking face plane and includes the face center; a sole portion having an upper sole surface and a bottom sole surface; a top portion opposite the sole portion; a toe portion; a heel portion opposite the toe portion; a rear face; a recess extending in a heel-to-toe direction along the upper sole surface and having a depth that varies in the heel-to-toe direction such that a first depth corresponds with a first location heelward of the face center and a second depth corresponds with a second location toe-ward of the face center, the first depth being no less than 10 mm and greater than the second depth by at least 5 mm; an insert received in the recess, the insert having a density no greater than 7.0 $g/cm^3$; and a center of gravity of the golf club head that is spaced no greater than 5.0 mm from the virtual center plane measured in the heel-to-toe direction.

Another golf club head according to a non-limiting example of the present disclosure may, when oriented in a reference position, in turn include: a loft no less than 40 degrees; a striking face having a face center, a leading edge, and a virtual striking face plane generally parallel to the striking face; a sole portion; a top portion; a toe portion; a heel portion opposite the toe portion; a virtual vertical center plane, perpendicular to the virtual striking face plane and passing through the face center; and a hosel. The hosel may include a hosel wall having a thickness no greater than 2.0 mm and defining a virtual central hosel axis, the hosel wall having an exterior surface and an interior surface; and an internal bore formed by the hosel wall, the internal bore configured to receive a golf club shaft. An indentation may be located on the exterior surface of the hosel, the indentation including: a first leg that extends in a first direction; and a second leg that extends in a second direction that is offset from the first direction by an angle no less than 75 degrees and no greater than 135 degrees. And a center of gravity of the golf club head may be spaced no greater than 5.0 mm from the virtual vertical center plane.

And in yet another non-limiting example of the present disclosure, a golf club head may, when oriented in a reference position, include: a loft no less than 40 degrees; a striking face having a face center, a leading edge, and a virtual striking face plane generally parallel to the striking face; a virtual center plane that is vertical and perpendicular to the virtual striking plane and includes the face center; a sole portion having an upper sole surface and a bottom sole surface; a top portion opposite the sole portion; a toe portion; a heel portion opposite the toe portion; a rear face; a recess extending in a heel-to-toe direction along the upper sole surface and having a depth that varies in the heel-to-toe direction such that a first depth corresponds with a first location heelward of the face center and a second depth corresponds with a second location toe-ward of the face center, the first depth being no less than 10 mm and greater than the second depth by at least 5 mm; and a hosel. The hosel may include: a hosel wall having a thickness no greater than 2.0 mm and defining a virtual central hosel axis, the hosel wall having an exterior surface and an interior surface; and an internal bore formed by the hosel wall, the internal bore configured to receive a golf club shaft. An indentation may be located on the exterior surface of the hosel, the indentation including: a first leg that extends in a first direction; and a second leg that extends in a second direction that is offset from the first direction by an angle no less than 75 degrees and no greater than 135 degrees. And a center of gravity of the golf club head may be spaced no greater than 5.0 mm from the virtual center plane.

These and other features and advantages of the invention in its various aspects and demonstrated by one or more of the various examples will become apparent after consideration of the ensuing description, the accompanying drawings, and the appended claims.

DETAILED DESCRIPTION

Figure 1:
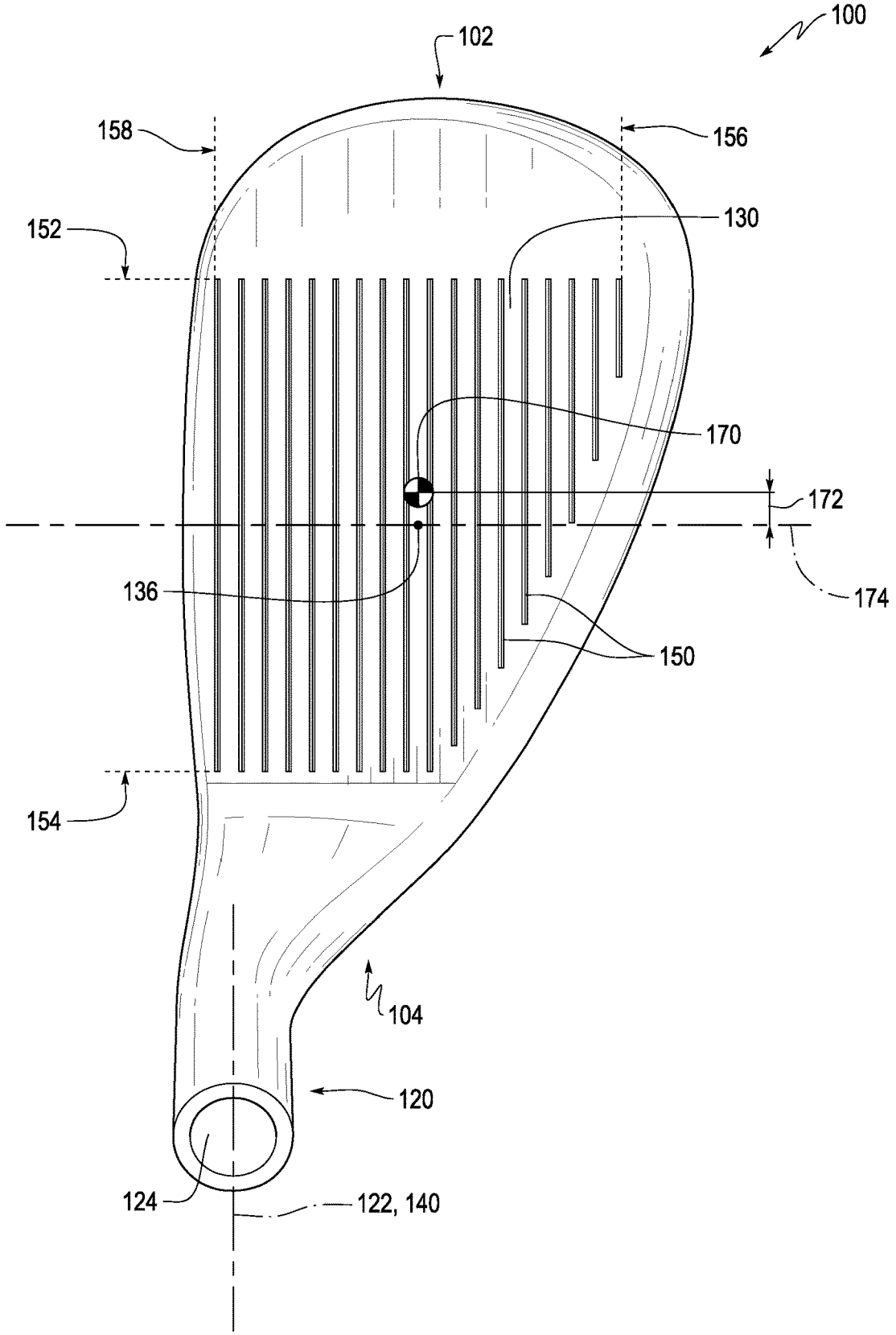
FIG. 1 shows a top plan view of a golf club head in accordance with one or more aspects of the present disclosure.
Figure 2:
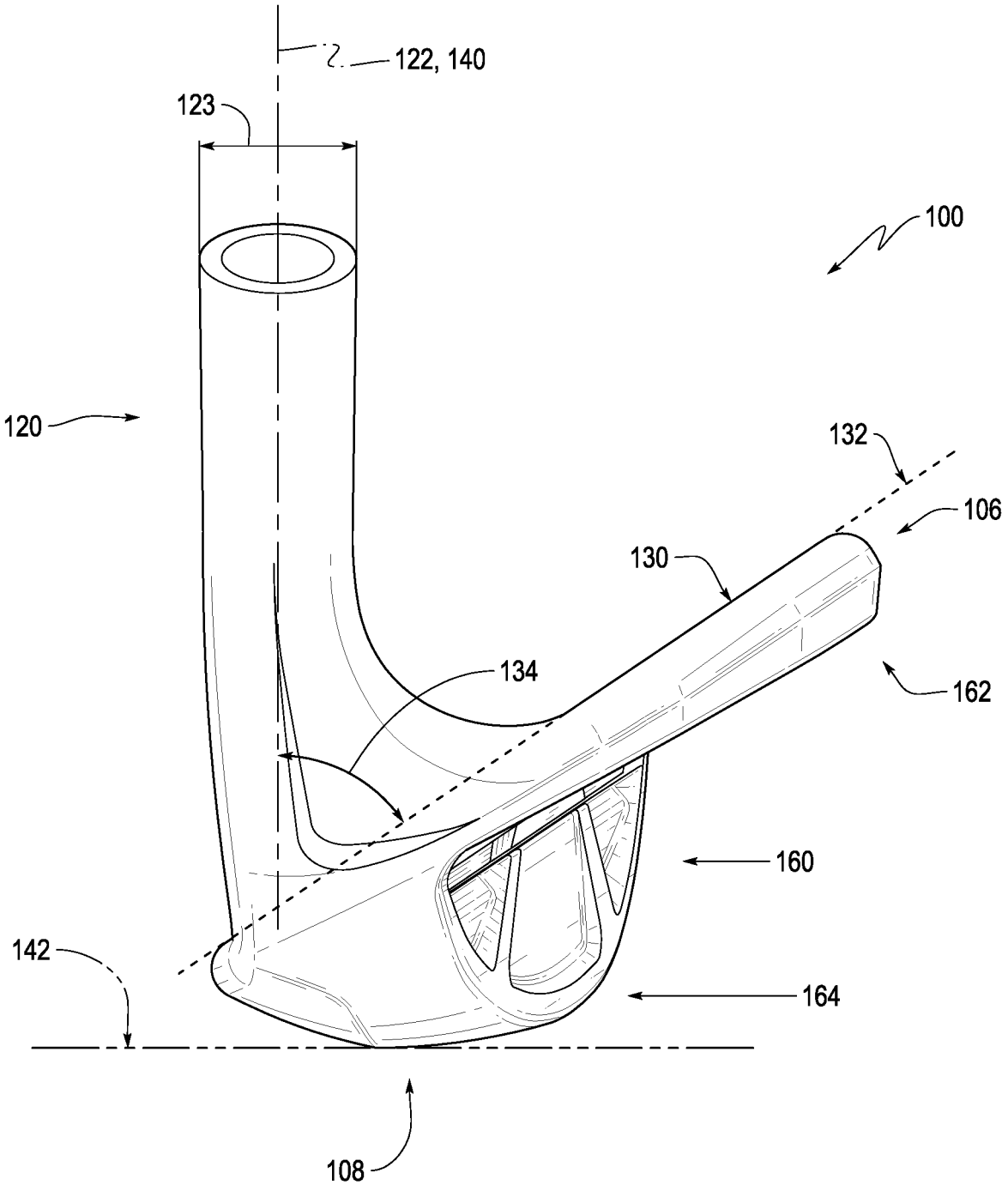
FIG. 2 shows a heel-side elevation view of the golf club head of FIG. 1.

Shown in, e.g., FIGS. 1 and 2 is a golf club head 100. The golf club head 100 may be a wedge-type golf club head, which may be included as part of a pitching wedge, a sand wedge, a gap wedge, or a lob wedge. The golf club head 100 may further, as a wedge-type club head, comprise a generally compact shape, e.g., have a main body constituting a generally blade-like upper portion and a thickened muscle portion constituting a lower portion. Nonetheless, as will be described further below, the golf club head 100 may still include a perimeter weighted element in conjunction with such delimited blade portion and muscle portion.

The golf club head 100 may be bounded by a toe 102, a heel 104 opposite the toe 102, a top portion 106, and a sole portion 108 opposite the top portion 106. A hosel 120 having an internal bore 124 for securing the club head 100 to an associated shaft (not shown) may extend from the area adjacent the heel 104. The hosel 120 may in turn define a virtual central hosel axis 122 and have a hosel outer diameter 123. The club head 100 may further include a striking face 130 at a front portion thereof. The striking face 130 is the substantially planar exterior surface part of the front portion that generally conforms to a virtual striking face plane 132 and that is arranged to contact a golf ball at a factory-designated loft angle 134 taken between the striking face plane 132 and the central hosel axis 122. This loft angle 134 may be no less than 40 degrees.

Additionally, the striking face 130 may be formed with surface features that increase traction between the striking face 130 and a struck golf ball to ensure both good contact with the ball (for example, in wet conditions) and impart a degree of spin to the ball, e.g., for stability in flight or to control better a struck golf ball once it has returned to the ground by way of backspin. Included in these surface features may be a grid of substantially parallel horizontal grooves or scorelines 150. The scorelines 150 may extend from a toe-ward extent 152 to a heel-ward extent 154 and from an upper extent 156 closest to the top portion 106 to a lower extent 158 closest to the sole portion 108. A face center 136 of the striking face 130 may be halfway between the heel-most extent 154 and the toe-most extent 152 of the scorelines 150 in the heel-to-toe direction and halfway between the uppermost extent 156 and the lowermost extent 158 of the scorelines 150 in the top-to-sole direction. And as shown particularly in FIG. 2, the rear portion 160 of the club head 100 may include the aforementioned upper blade portion 162 and muscle portion 164.

The golf club head 100 in FIGS. 1 and 2 is shown in the "reference position." As used herein, "reference position" denotes a position of the golf club head where the hosel axis 122 is in a virtual vertical plane 140 relative to a virtual ground plane 142 and parallel to a heel-to-toe axis of the golf club head, e.g., parallel with the scorelines 150 located on the striking face 130, wherein the sole portion 108 of the club head rests against the virtual ground plane 142. In FIG. 1, the virtual ground plane 142 is parallel with the plane of the paper. Unless otherwise indicated, all parameters of the various embodiments of the disclosure are specified with the golf club head oriented in the reference position.

The golf club head 100 may have a center of gravity 170 spaced in the heel-to-toe direction by a distance 172 from a virtual vertical center plane 174 that passes through the face center 136 of the striking face 130 and is perpendicular to the striking face plane 132 that is generally parallel to the striking face 130. As shown in FIG. 1, the center of gravity 170 may be spaced toe-ward from the virtual vertical center plane 174. The distance 172 may preferably be no greater than 5.0 mm, more preferably no greater than 2.0 mm. More preferably, the distance 172 may be no greater than 1.5 mm. And even more preferably, the distance 172 may be 0.5 mm to 1.5 mm. As described above, such configuration in which the center of gravity 170 is moved toward the toe portion 102 may result in a sweet spot and/or sweet area more suitable for higher-handicapped golfers.

Figure 11:
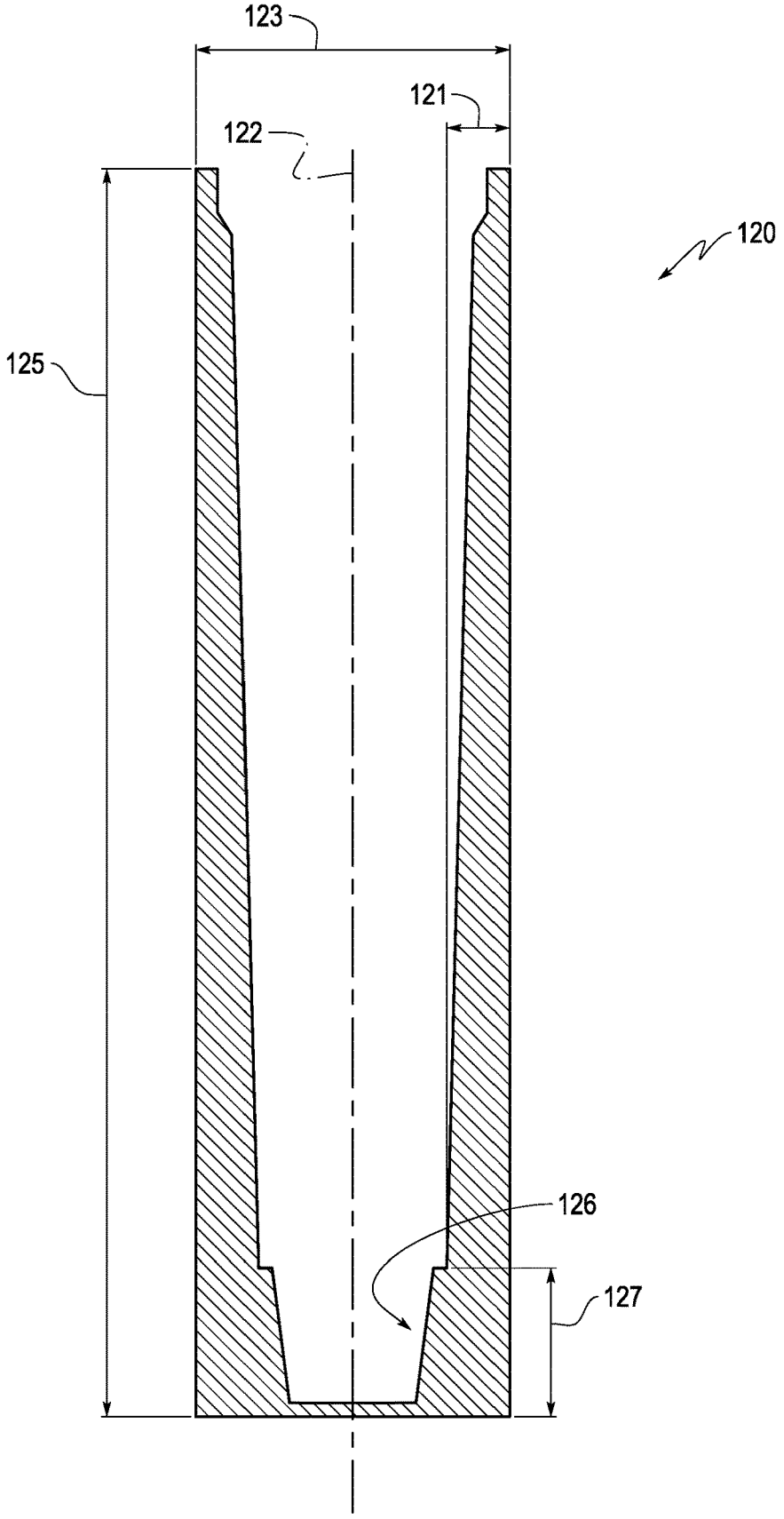
FIG. 11 shows a schematic view of the hosel of the golf club head of FIG. 1.

The hosel 120 may also be particularly structured to discreetly but substantially shift the center of gravity 170 of the golf club head 100 more towards the toe portion 102. As shown in FIG. 11, such structuring may include general mass removal from the hosel 120, e.g., in the form of manipulating its structural dimensions. For example, the hosel 120 may include a hosel wall having a thickness 121 preferably less than 2.0 mm. Preferably, the hosel wall thickness 121 may be less than 1.5 mm. In some embodiments, the hosel wall thickness 121 may be about 1.3 mm. Preferably, the hosel wall thickness 121 may be at least 1.0 mm. The hosel wall thickness 121 may be such that the structural integrity of the golf club head 100 is not compromised even upon repeated impacts with a golf ball or the ground during play. In one or more embodiments, the outer diameter (OD) 123 of the hosel 120 may be no greater than 13.5 mm. More preferably, the hosel OD 123 may be less that 13.0 mm.

In one or more embodiments, the internal hosel bore 124 of the golf club head's hosel 120 may have a depth 125, as measured along the central hosel axis 122 from an upper end of the hosel, of no less than 40 mm. In one or more embodiments, the internal bore depth 125 may be no less than 44 mm. The internal bore depth 125 may be such that the structural integrity of the hosel 120 and the golf club head 100 is not compromised. Preferably, the internal hosel bore 124 may not extend entirely through the golf club head 100. In other words, the hosel bore 124 may not extend through the sole portion 108 of the golf club head 100. Accordingly, structural difficulties such as appropriately contouring the sole surface to be flush with adjacent surfaces and/or exhibit a particularly suitable camber may be avoided as well as the manufacturing expenses associated therewith.

In one or more embodiments, and as further shown in FIG. 11, the internal hosel bore 124 of the golf club head 100 may include an auxiliary, or second, hosel cavity 126 below a golf club shaft when the golf club shaft is received in the internal hosel bore 124. The auxiliary hosel cavity 126 may be substantially coaxial with the remainder of the internal hosel bore. In one or more embodiments, the depth 127 of the auxiliary hosel cavity 126 may be no less than 12.0 mm. Preferably, the cavity depth 127 may be no less than 15.0 mm and no greater than 25.0 mm. And even more preferably, the cavity depth 127 may be about 18.0 mm.

Figure 3:
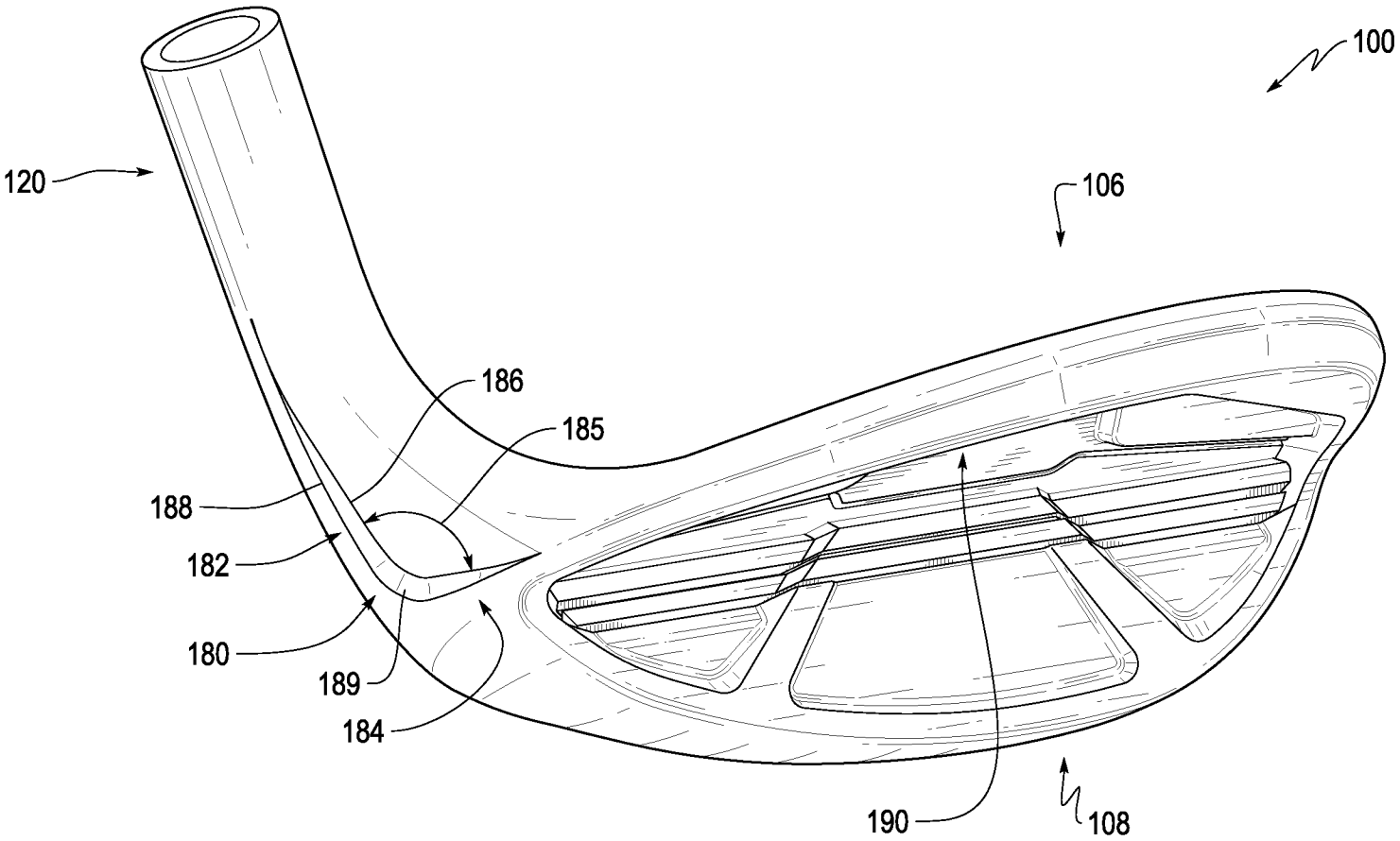
FIG. 3 shows a rear, heel-side perspective view of the golf club head of FIG. 1.
Figure 4:
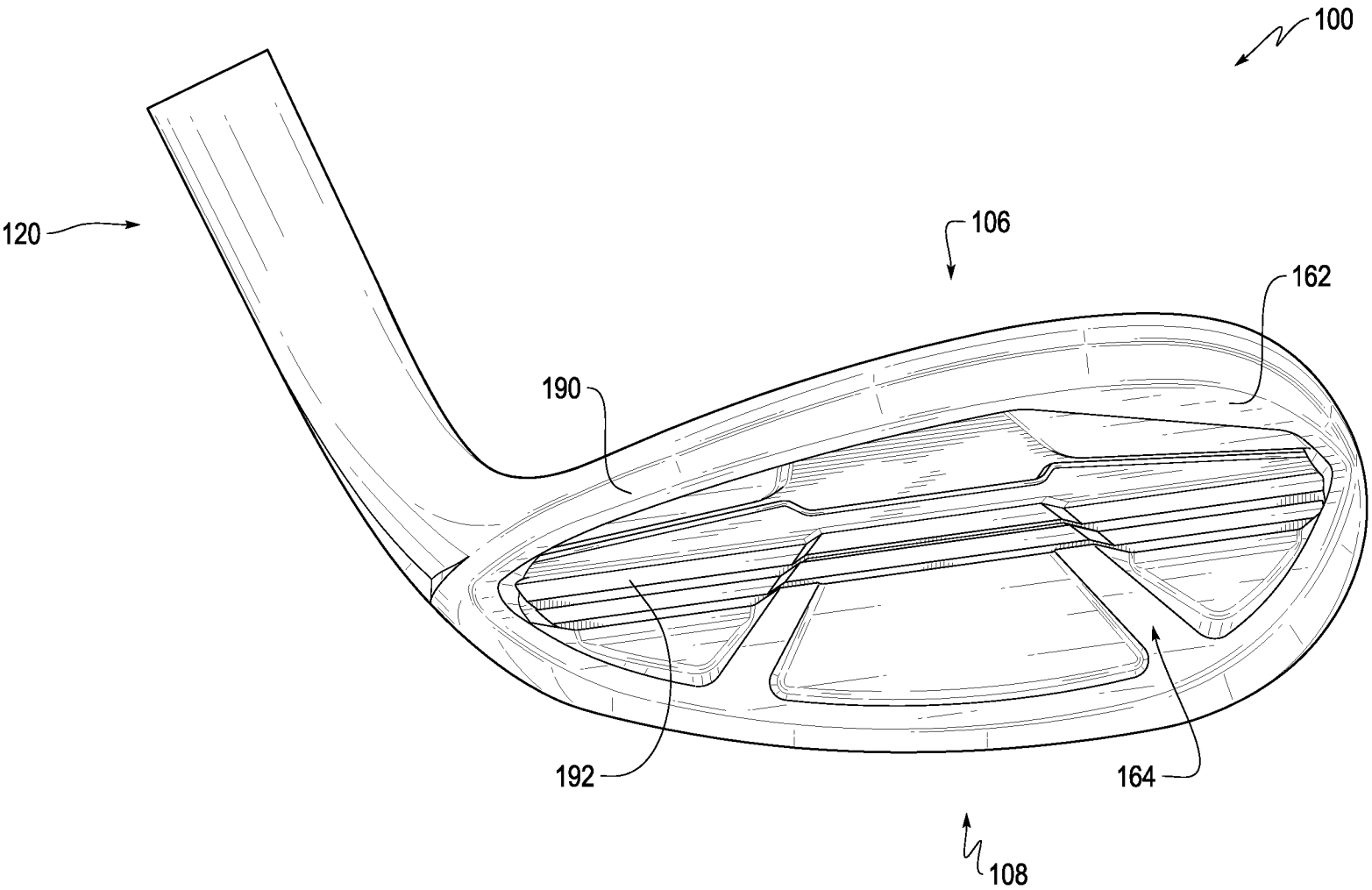
FIG. 4 shows a rear view of the golf club head of FIG. 1.

In one or more embodiments, and as shown in FIG. 3, an exterior surface of the hosel 120 wall may include an indentation 180 such as a recess. The indentation 180 may serve to discretely remove mass from the heel side of the golf club head 100 and thus move the CG 170 towards the toe side of the golf club head. The indentation 180 may include a first leg 182 and a second leg 184 that are angled from one another by an angle 185. The angle 185 may be no less than 75 degrees, and it may be no greater than 135 degrees. Preferably, the angle may be about 90 degrees. In a preferred embodiment, the indentation may not be visible at address. Preferably, and as shown in FIG. 1, the indentation may not be visible when viewed from above when the golf club head 100 is in the reference position. If the indentation 180 is visible when the golfer addresses the golf ball, the golfer may become distracted by the indentation since it is not a traditional feature of a golf club head. Such a distraction may contribute to the golfer making a poor golf shot. However, while the indentation in these embodiments is not visible at address, the indentation may be a highly visible feature when viewed from other angles. For example, the indentation may be made to stand out by color and/or texture and thus signify to the golfer that the golf club head includes technologies to move the CG 170 to a more favorable location.

As further shown in FIG. 3, the indentation in some embodiments may include an interior edge 186 and an exterior edge 188. The interior edge 186 may preferably smoothly transition to the adjacent contour of the main body of the club head, while the exterior edge 188 may abruptly transition to the adjacent surface of the main body and thereby form a step. The height of the step above the main body of the club head, i.e., the distance between the interior 186 and exterior 188 edges, may preferably be no less than 0.5 mm. More preferably, this height may be no less than 1.0 mm and no greater than 3.0 mm. This structure maximizes mass removal at areas most heel-ward, and it further results in an indentation that is visible but makes less noticeable the degree to which mass is removed from the hosel 120. A radiused region 189 of the exterior edge of the indentation may soften the angled junction between the first leg 182 and the second leg 184 and may reduce stress concentrations. The combination of having first and second elongate legs 182, 184 of the indentation 180 and having such legs so angled may serve to both maximize the degree to which mass may be removed from the hosel region while minimizing the discernibility of the indentation when viewed by a golfer at address.

In each of the aforementioned embodiments, mass is generally removed from the hosel portion. This strategy is believed to bear several surprising benefits. For example, through inspection, the hosel 120 has been identified as a region of a golf club head in which mass could be removed without substantial detriment to the feel and performance of the club head, e.g., the hosel is believed to conventionally include a high proportion of discretionary mass and may be considered overweight. Second, in the context of the overall goal of shifting the center of gravity 170 toe-ward, mass removal from the hosel may be considered to serve multiple purposes. The mass removal itself significantly shifts the center of gravity toe-ward due to the natural heel-ward location of the hosel. Also, the resulting discretionary mass removed from the hosel may be advantageously re-positioned in a toe-ward location provided an overall club head mass budget. Third, mass could be removed from the hosel in a manner that is discreet. For example, removing material about the internal bore 124 or reducing the hosel wall thickness 121 is not discernible to an observer once a shaft is affixed atop the hosel.

Figure 5:
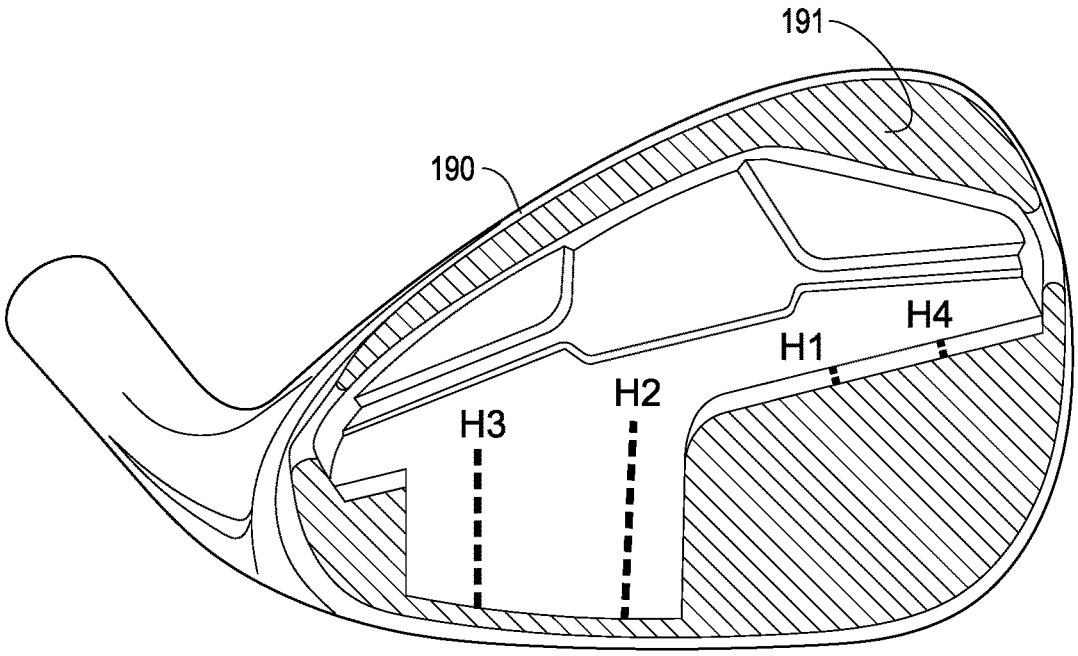
FIGS. 5 and 6 show rear cutaway views of the golf club head of FIG. 1.
Figure 6:
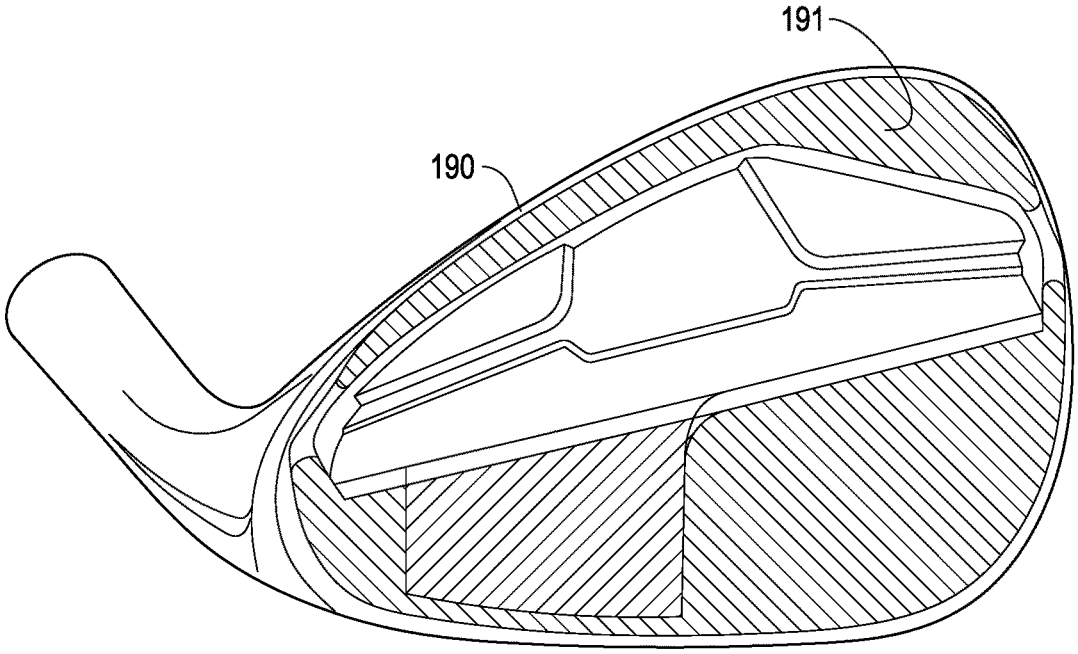
Figure 7:
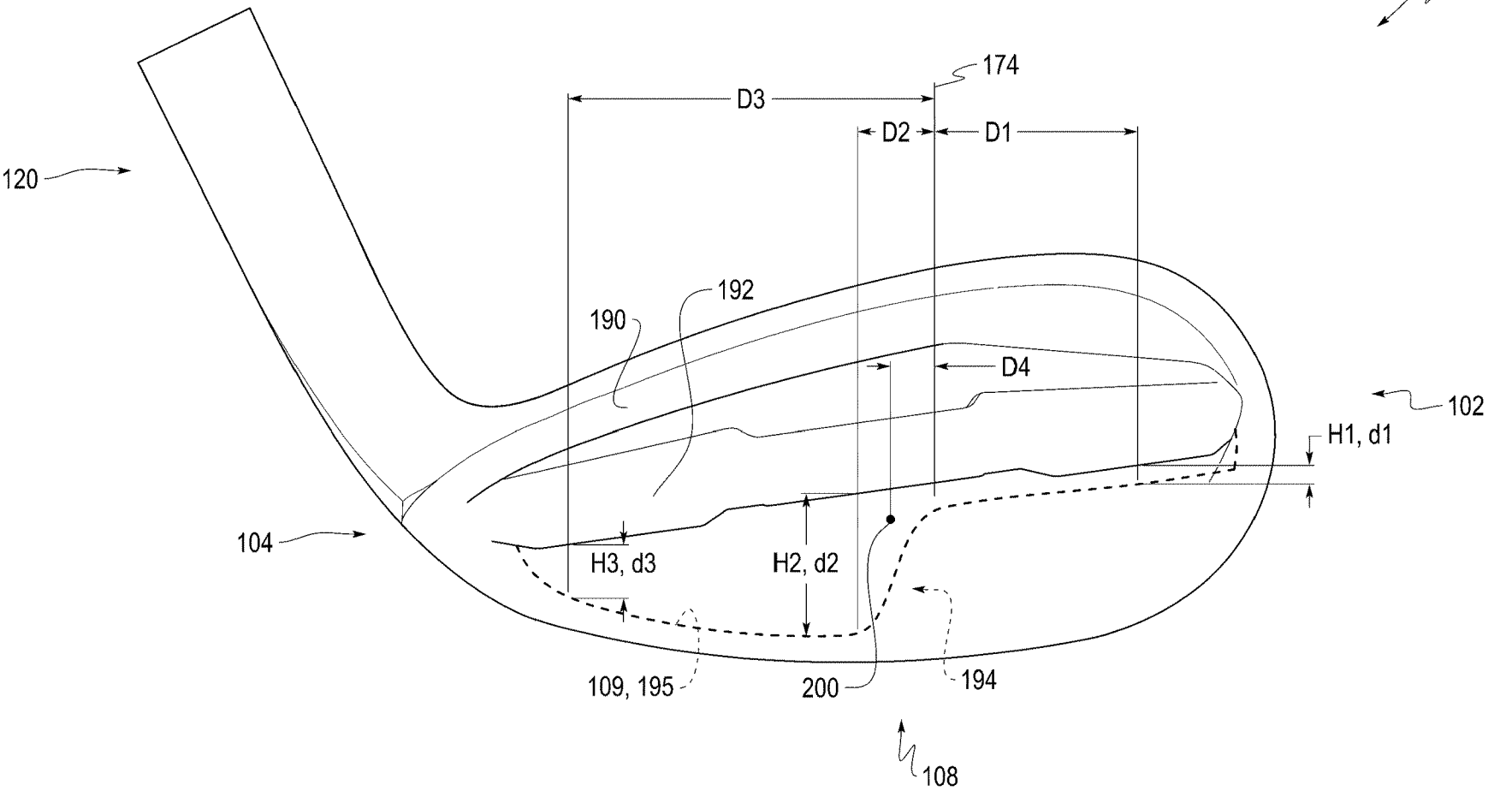
FIG. 7 shows a rear schematic view of the golf club head of FIG. 1.
Figure 10:
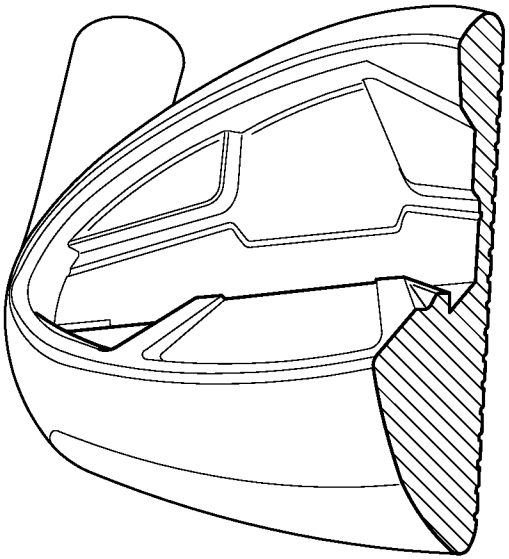
FIGS. 8-10 show cross-sectional views of the golf club head of FIG. 1 at distances D3, D2, and D1, respectively, of FIG. 7.
Figure 9:
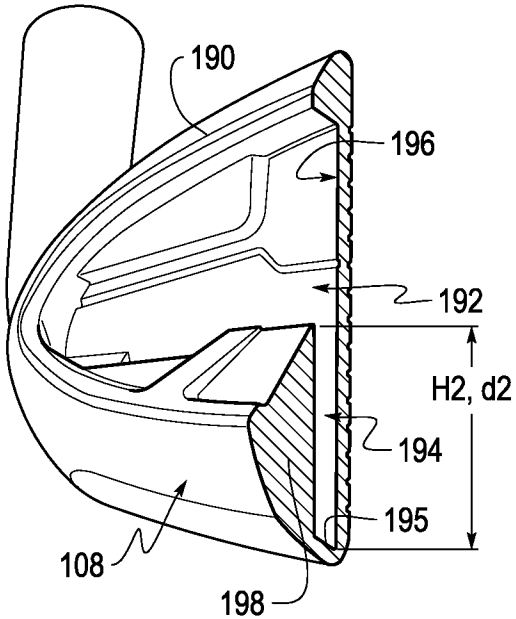
Figure 8:
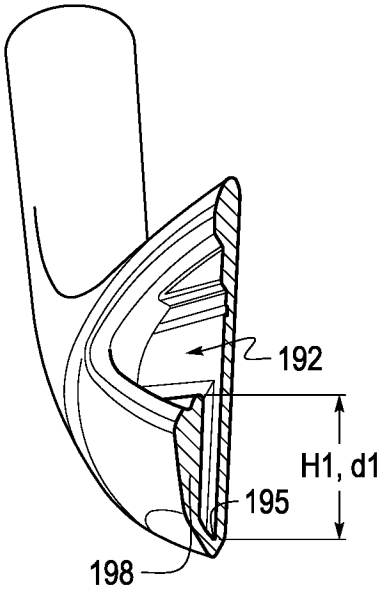

As mentioned previously, in one or more embodiments, the golf club head 100 may include the upper blade portion 162 and the lower muscle portion 164 proximate and formed in the sole portion 108. Nonetheless, a perimeter weighting element 190 may span about the periphery of the rear surface of the club head to form therebetween a rear cavity 192. As shown in FIG. 5, the perimeter weighting element 190 may include a widened portion 191 at an upper toe side of the rear face. As shown in, e.g., FIGS. 7-9, a secondary recess 194 may adjoin the rear recess 192 and extend therefrom into the sole portion 108. The secondary recess 194 may preferably extend depthwise in a soleward direction preferably generally parallel to the striking face plane 132 and in some cases adjacent to the striking wall such that a rear surface 196 of the striking wall forms a forward side surface of the secondary recess. The secondary recess 194 may also be elongate in the heel-to-toe direction so as to form a parametric boundary along an upper surface of the sole portion. As shown particularly in FIGS. 8-10, the secondary recess 194 may take the form of a channel or slot. The secondary recess 194 may further define a rear side surface formed in the sole portion and thus the sole may be considered to bear an upward extending sole wall portion 198 particularly as viewed in cross-section as shown in FIGS. 8-10.

This sole wall portion 198 may have a varying wall height measured parallel to the striking face plane 132 in a direction perpendicular to the heel-to-toe direction, i.e., a direction perpendicular to the direction of scorelines 150 of the striking face 130. The secondary recess 194 may preferably extend and, thus, the upwardly extending sole wall portion 198 may preferably be formed such that, as shown in FIG. 7, at a first cross-sectional location spaced a distance D1 toe-ward from the virtual vertical center plane 174, a height H1 of the sole wall portion may be no greater than 5.0 mm or 0 mm to 5.0 mm, more preferably between 1.0 mm and 2.0 mm. Here, D1 may be 0 mm to 40 mm, more preferably between 10 mm and 20 mm, and even more preferable equal to about 15 mm. At a second cross-sectional location spaced a distance D2 heel-ward from the virtual vertical center plane 174, a height H2 of the sole wall portion 198 may be between 5.0 mm and 20 mm, more preferably no less than 10 mm, and even more preferably between 10 mm and 20 mm. At a third cross-sectional location spaced a distance D3 heel-ward from the virtual vertical center plane 174 and located such that the second cross-sectional location is intermediate from the first and third cross-sectional locations in the heel-to-toe direction (optionally equidistant between the first location and the third location so that the increment of heel-to-toe spacing between each location is, e.g., 15 mm), a third height H3 of the sole wall portion 198 may be no less than 10 mm, more preferably 10 mm to 20 mm. Preferably, D3 may be greater than D2 by between 5.0 mm and 20 mm, more preferably by between 10 mm and 20 mm, and even more preferably by about 15 mm.

Preferably, H3 may be less than H2 and H2 may be greater than or equal to 15 mm primarily as a result of the oblique dimensioning of the upper surface 109 of the sole portion 108 to be obliquely angled in the heel-to-toe direction. The height H of the upwardly extending sole wall portion 198 may generally be considered to be commensurate with a corresponding secondary recess depth, d, at the same heel-to-toe location and thus all recitations of heights H herein should be considered to implicitly disclose corresponding secondary recess depths d of the same values.

In one or more of the embodiments described above, preferably all cross-sectional locations, i.e., the first, second and third locations at distances D1, D2, and D3 may pass through a portion of the secondary recess 194. Furthermore, preferably, the average depth of the portion of the secondary recess 194 extending toe-ward of the virtual central vertical plane 174 is no greater than 10 mm, more preferably no greater than 5.0 mm, and even more preferably between about 2.0 mm and 5.0 mm. Additionally, or alternatively, the average depth of the portion of the secondary recess 194 extending heel-ward of the virtual vertical central plane 174 may preferably be no less than 10 mm, more preferably between 10 mm and 25 mm, even more preferably between 12 mm and 20 mm, and yet even more preferably equal to about 15 mm. Additionally, or alternatively, a difference between the depth, d2, of the secondary recess at the second location at D2 and the depth, d1, of the recess at the first location D1 may be no less than 2.0 mm, more preferably greater than 5.0 mm, even more preferably between 5.0 mm and 25 mm, and yet even more preferably between 5.0 mm and 20 mm. Alternatively, or in addition, a ratio d1/d2 may be no less than 0.10, more preferably between 0.10 and 0.50, even more preferably between 0.10 and 0.30. Additionally, or alternatively, the secondary recess 194 may comprise a maximum depth, dmax, located heel-ward of the virtual vertical central plane 174. The depth dmax may preferably be no less than 15 mm, more preferably no less than 20 mm.

In one or more embodiments, the secondary recess 194 may have a recess bottom surface 195 that is substantially farther from a virtual horizontal center plane, which passes through the face center and is parallel to the scorelines 150, on the heel side than on the toe side. The recess bottom surface 195 may be planar, e.g., parallel to the virtual ground plane 142, or it may follow a contour of the sole portion 108 of the golf club head 100.

In one or more embodiments, the golf club head 100 may further include a recess insert. For practical reasons, this insert has been omitted from some of FIGS. 5-10. The recess insert may preferably have a density lower than the golf club head's main body. For example, the golf club head's main body may be a stainless steel and the recess insert may be a thermoplastic polyurethane or aluminum. In one or more embodiments, the recess insert may have a density no greater than 7.0 g/cm$^3$, more preferably no greater than 5.0 g/cm$^3$, and even more preferably no greater than 3.0 g/cm$^3$. The insert may also have a heel-to-toe width and, as shown in FIG. 7, a heel-to-toe midpoint 200. This heel-to-toe midpoint 200 may be spaced from the virtual vertical central plane 174 by a distance D4 in the heel-to-toe direction of no greater than 5.0 mm.

In some such embodiments, the insert may entirely fill the secondary recess 194 and may in such cases comprise a co-molded component or a poured in component permitted to cure in place subsequent to the formation of the main body of the club head 100. Alternatively, the insert may be an after-attached component secured by chemical means, adhesive material such as two-sided adhesive tape optionally including a visco-elastic layer or element, mechanical fastening, interference fit, bonding, welding, or brazing. However, the recess insert preferably only partially fills the secondary recess. That is, the recess insert may be smaller in at least one of a top-to-sole direction and a striking face-to-rear direction than a corresponding dimension of the secondary recess 194 or otherwise permit gapping between the insert and the main body of the club head. In some embodiments, the insert may comprise a cap element providing for a flush upper surface of the sole portion 108 while leaving a majority, more preferably at least 80% of the volume of the secondary recess 194 to be hollow.

A lower portion of the recess insert may be sized such that only a part of the secondary recess 194 is filled by the lower portion. In such an embodiment, a gap, optionally a substantially or fully enclosed hollow region, is formed between the insert and the sole portion 108. One manufacturing advantage of this feature is that the same design for the insert may be utilized for a variety of golf club heads having, e.g., different lofts, which may have differently sized secondary recesses to optimize the mass properties for each loft. Alternatively, hollow portions may be formed elsewhere between the insert and the main body of the club head 100 and, in some cases, entirely within the insert itself. In some embodiments, the insert may be smaller in volume than the secondary recess 194 such that at least a portion, or in some embodiments, the entirety of, the insert is recessed below the peripheral edge of the secondary recess 194. In other cases, preferably, the insert top surface may be substantially flush with the adjacent edge of the secondary recess 194. In yet other cases, the insert at least partially protrudes from the adjacent contour of the sole portion 108.

Regardless of the length or depth of the secondary recess 194 shown in the figures, the recess insert preferably constitutes an opaque, or semi-opaque material and preferably obscures the dimensions of the secondary recess from view. In other words, the insert is preferably configured and secured to the main body such that a golfer is not able to discern a recess in the upper sole surface that is substantially deeper on the heel side because the recess insert extends in a heel-to-toe direction and covers the secondary recess 194 in any of the manners described above.

Figure 12:
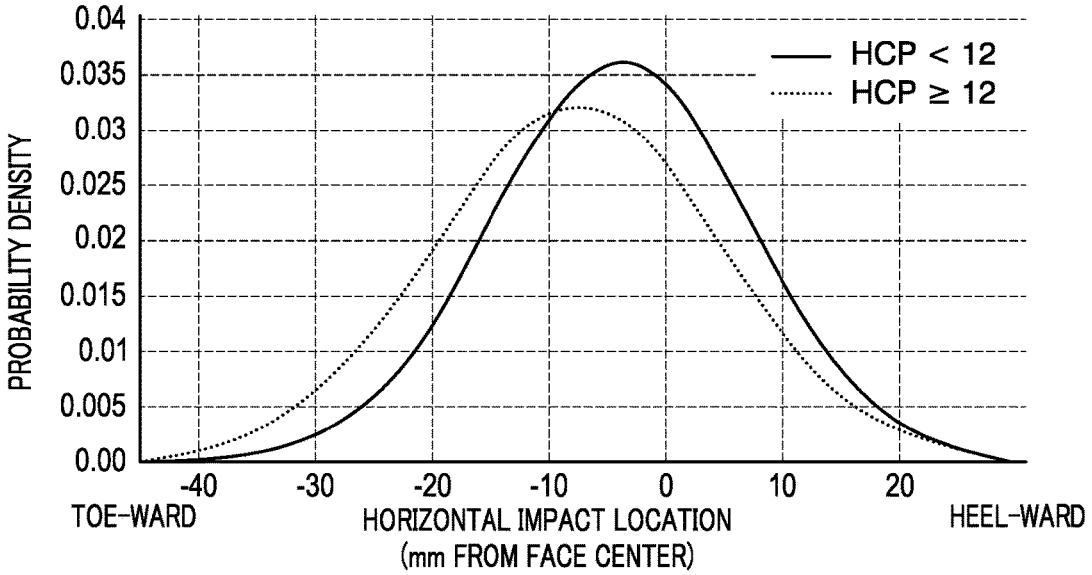
FIG. 12 shows a probability distribution for horizontal impact location of golf shots for higher and lower handicap golfers.
Figure 14:
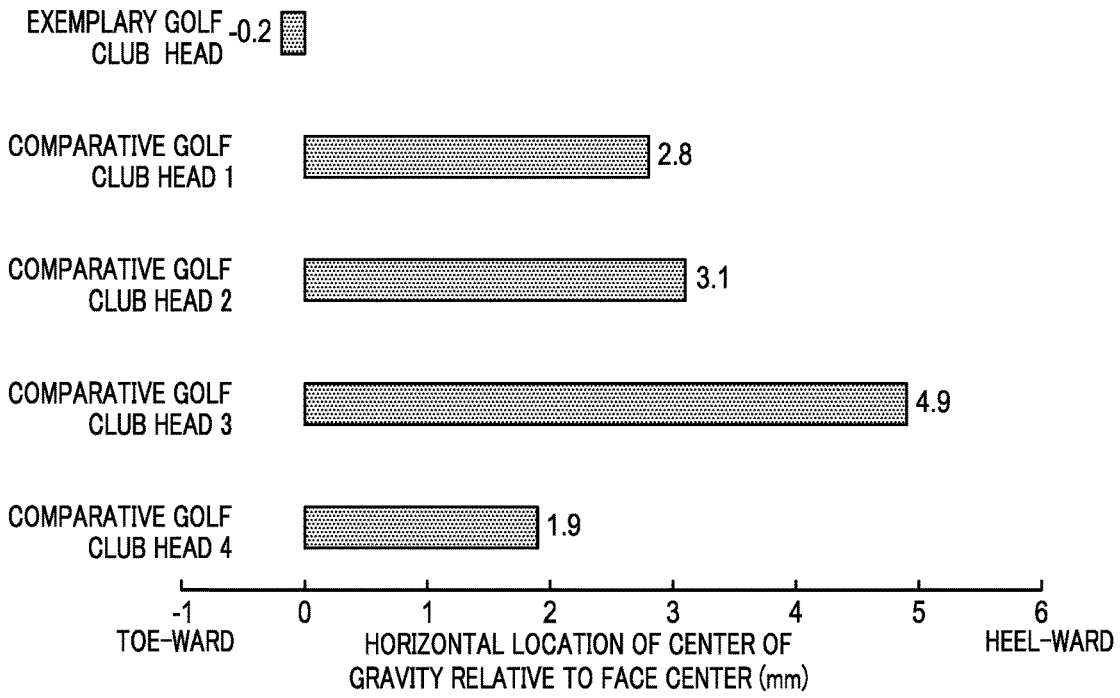
FIG. 14 shows a comparison of the horizontal location of the center of gravity of an exemplary golf club head with those of comparative golf club heads.

As noted above, and as shown in FIG. 12, test data shows that higher handicap golfers tend to hit shots more toe-ward than golfers with a lower handicap. By including one or more features of the embodiments describe above and moving the CG 170 toe-ward, higher handicap golfers can hit higher ball speed shots with less dispersion. FIG. 14 compares the center of gravity of an exemplary golf club head such as the golf club head 100 to that of comparative golf club heads 1-4. As can be seen, and contrary to the exemplary golf club head, the centers of gravity of those comparative golf club heads are all substantially heel-ward of the face center. The comparative golf club heads thus lack the advantages discussed above associated with relocating the center of gravity.

Figure 13:
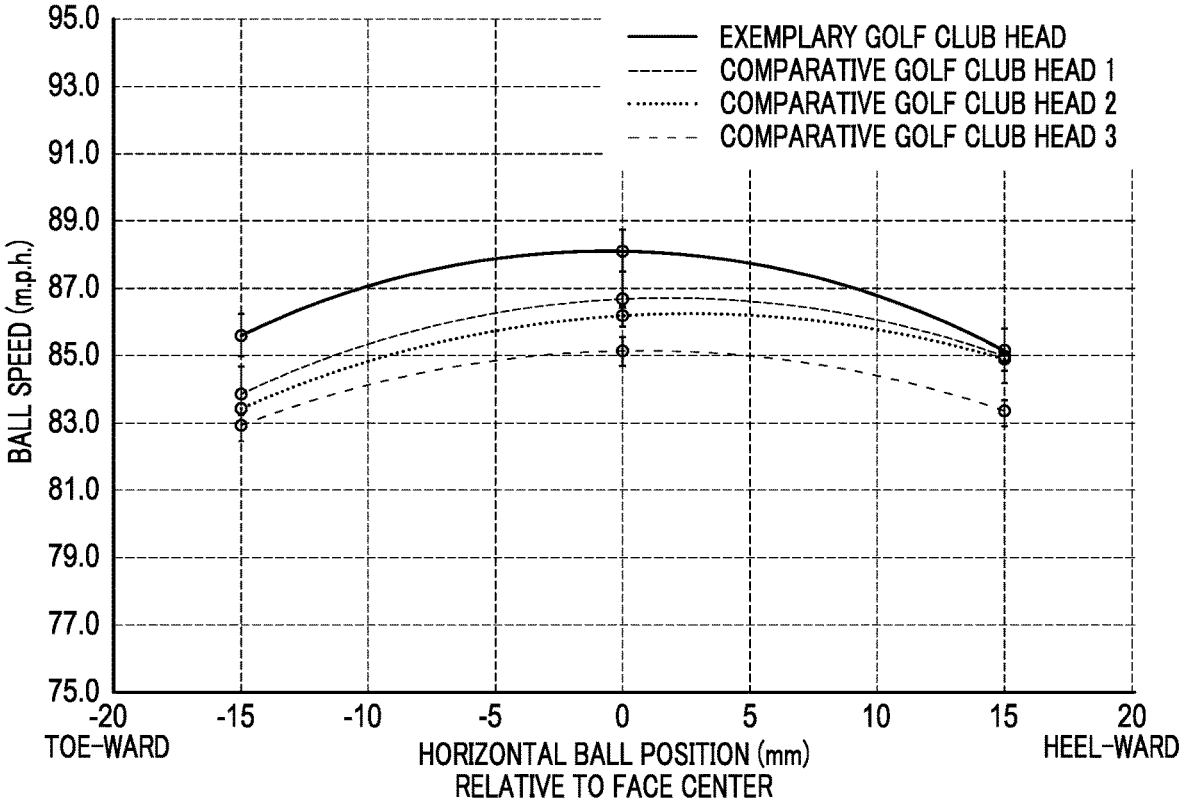
FIG. 13 shows differences in horizontal location of peak ball speed between an exemplary golf club head and comparative golf club heads.
Figure 15:
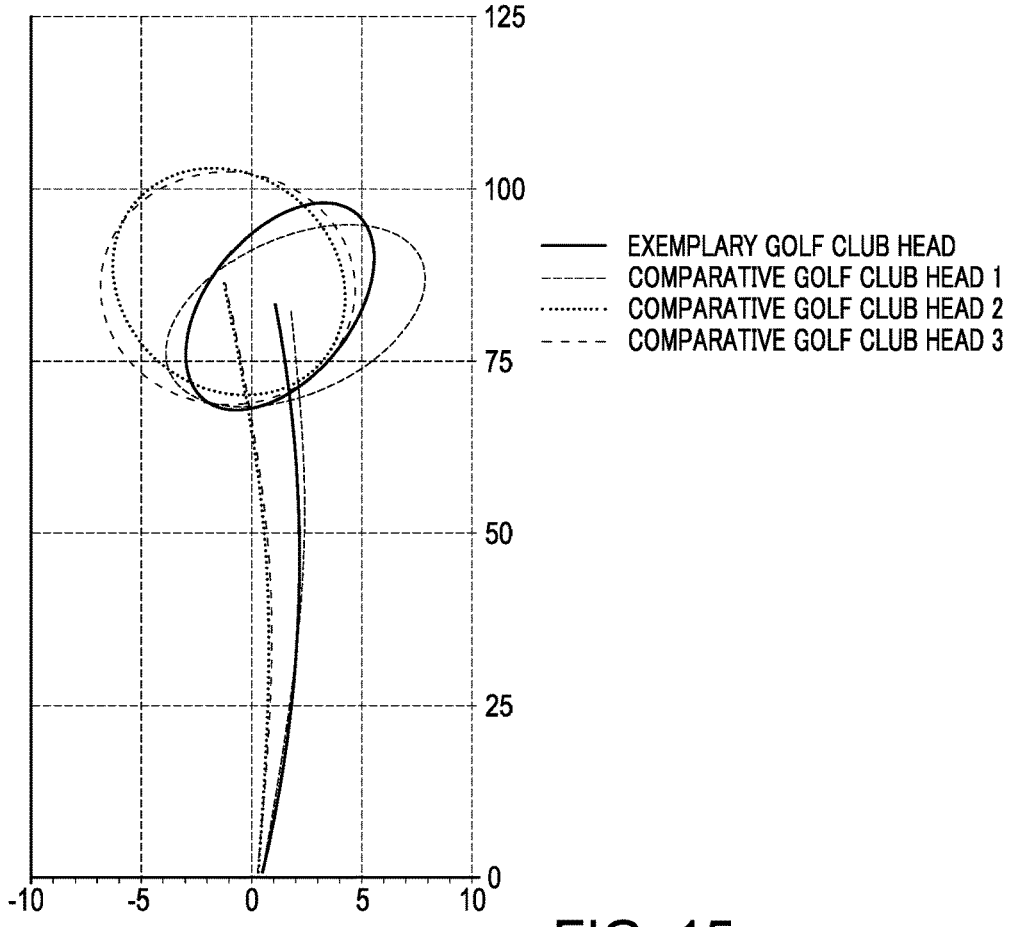
FIG. 15 shows a comparison of the shot dispersion of an exemplary golf club head with those of comparative golf club heads.

Further, compared to prior art golf club heads, and as shown in FIG. 13, the peak ball speed of the exemplary golf club head such as the golf club head 100 may be achieved at a location more toe-ward of the striking face. Indeed, whereas the peak ball speed of the exemplary golf club head may be achieved from impact with the golf ball at or near the face center, the peak ball speeds of the comparative club heads are achieved heel-ward of the face center. The exemplary golf club head also shows greater ball speed than the comparative club heads for shots struck toe-ward of the face center. And as made clear in FIG. 15 and Table 1 below, the exemplary golf club head 100 may have substantially lower shot dispersion than the comparative club heads. In this Figure and Table, the reference ovals illustrate the area encompassed by the landed golf shots.

TABLE 1

| | Oval Dispersion (yds) | Oval Dispersion Control (yds) | Total Oval Area ($yds^2$) |
|---|---|---|---|
| Comparative Golf Club Heads | 10.5 | 32.7 | 127.8 |
| | 11.7 | 33.3 | 145.0 |
| | 10.6 | 26.5 | 104.3 |
| Exemplary Golf Club Head | 7.4 | 30.6 | 83.7 |

While various features have been described in conjunction with the examples outlined above, various alternatives, modifications, variations, and/or improvements of those features and/or examples may be possible. Accordingly, the examples, as set forth above, are intended to be only illustrative. Various changes may be made without departing from the broad spirit and scope of the underlying principles.

We claim:

1. A golf club head that, when oriented in a reference position, comprises:
- a loft no less than 40 degrees;
- a striking face having a face center, a leading edge, and a virtual striking face plane generally parallel to the striking face;
- a sole portion, including:
  - an upper sole surface;
  - a bottom sole surface; and
  - a recess extending in a heel-to-toe direction along the upper sole surface and having a depth that varies in the heel-to-toe direction such that a first depth corresponds with a first location heelward of the face center and a second depth corresponds with a second location toe-ward of the face center, the first depth being between 10 mm and 20 mm and greater than the second depth by between 5 mm and 18 mm;
- a top portion;
- a toe portion;
- a heel portion opposite the toe portion;
- a virtual vertical center plane, perpendicular to the virtual striking face plane and passing through the face center;
- a hosel comprising:
  - a hosel wall having a thickness no greater than 2.0 mm and defining a virtual central hosel axis, the hosel wall having an exterior surface and an interior surface; and
  - an internal bore formed by the hosel wall, the internal bore configured to receive a golf club shaft;
- an indentation located on the exterior surface of the hosel, the indentation comprising:
  - a first leg that extends in a first direction; and
  - a second leg that extends in a second direction that forms an angle with respect to the first direction of no less than 75 degrees and no greater than 135 degrees;
  - an interior edge of the indentation formed at least in part by the first leg and the second leg, the interior edge shaped to smoothly transition to a first portion of the exterior surface of the hosel adjacent the indentation;
  - an exterior edge of the indentation formed at least in part by the first leg and the second leg, the exterior edge shaped to abruptly transition to a second portion of the exterior surface of the hosel adjacent the indentation, the second portion being located on an opposite side of the indentation from the first portion, wherein the exterior edge comprises a radiused region disposed between the first leg and the second leg; and
- a center of gravity of the golf club head spaced no greater than 5.0 mm from the virtual vertical center plane.

2. The golf club head of claim 1, wherein the hosel wall thickness is no greater than 1.5 mm.

3. The golf club head of claim 1, wherein the indentation has an indentation height of at least 1.0 mm.

4. The golf club head of claim 1, wherein a depth of the internal bore is no less than 44 mm.

5. The golf club head of claim 1, wherein the internal bore does not extend entirely through the golf club head.

6. The golf club head of claim 5, wherein the indentation is not visible when the golf club head is viewed from above.

7. The golf club head of claim 1, wherein the internal bore is configured, when the golf club shaft is fixedly received therein, to include a secondary cavity sole-ward of the golf club shaft, the secondary cavity having a depth no less than 12.0 mm.

8. The golf club head of claim 7, wherein a depth of the secondary cavity is no less than 15.0 mm and no greater than 25.0 mm.

9. The golf club head of claim 1, wherein the center of gravity is spaced no greater than 1.5 mm from the virtual vertical center plane in a heel-to-toe direction.

10. The golf club head of claim 1, further comprising an insert received in the recess, the insert having a density less than 3.0 $g/cm^3$.

11. A golf club head that, when oriented in a reference position, comprises:
- a loft no less than 40 degrees;
- a striking face having a face center, a leading edge, and a virtual striking face plane generally parallel to the striking face;
- a virtual center plane that is vertical and perpendicular to the virtual striking plane and includes the face center;
- a sole portion having an upper sole surface and a bottom sole surface;
- a top portion opposite the sole portion;
- a toe portion;
- a heel portion opposite the toe portion;
- a rear face;

a recess extending in a heel-to-toe direction along the upper sole surface and having a depth that varies in the heel-to-toe direction such that a first depth corresponds with a first location heelward of the face center and a second depth corresponds with a second location toeward of the face center, the first depth being no less than 10 mm and greater than the second depth by at least 5 mm;

a hosel comprising:

a hosel wall having a thickness no greater than 2.0 mm and defining a virtual central hosel axis, the hosel wall having an exterior surface and an interior surface; and an internal bore formed by the hosel wall, the internal bore configured to receive a golf club shaft;

an indentation located on the exterior surface of the hosel, the indentation comprising:

a first leg that extends in a first direction;

a second leg that extends in a second direction that forms an angle with respect to the first direction of no less than 75 degrees and no greater than 135 degrees;

an interior edge of the indentation formed at least in part by the first leg and the second leg, the interior edge shaped to smoothly transition to a first portion of the exterior surface of the hosel adjacent the indentation; and an exterior edge of the indentation formed at least in part by the first leg and the second leg, the exterior edge shaped to abruptly transition to a second portion of the exterior surface of the hosel adjacent the indentation, the second portion being located on an opposite side of the indentation from the first portion, wherein the exterior edge comprises a radiused region disposed between the first leg and the second leg; and a center of gravity of the golf club head spaced no greater than 5.0 mm from the virtual center plane.

12. The golf club head of claim 11, further comprising an insert received in the recess, the insert having a density less than 7.0 g/cm$^3$.

* * * * *